US006557975B2

(12) United States Patent
Sugioka

(10) Patent No.: US 6,557,975 B2
(45) Date of Patent: May 6, 2003

(54) INK JET RECORDING HEAD, INK JET RECORDING APPARATUS, AND INK JET RECORDING METHOD

(75) Inventor: Hideyuki Sugioka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/918,447

(22) Filed: Aug. 1, 2001

(65) Prior Publication Data

US 2002/0021329 A1 Feb. 21, 2002

(30) Foreign Application Priority Data

Aug. 4, 2000 (JP) ..... 2000-236888

(51) Int. Cl.[7] ..... B41J 2/14; B41J 2/16; B41J 2/05

(52) U.S. Cl. ..... 347/48; 347/61

(58) Field of Search ..... 347/58, 59; 219/216, 219/541, 543, 553; 338/306–309

(56) References Cited

U.S. PATENT DOCUMENTS 5,927,206 A * 7/1999 Bacon et al. ..... 101/453
6,132,032 A * 10/2000 Bryant et al. ..... 347/59

FOREIGN PATENT DOCUMENTS

| | | |
|---|---|---|
| EP | 0 995 600 A2 | 4/2000 |
| EP | 0 999 050 | 5/2000 |
| JP | 57-36679 | 2/1982 |
| JP | 357182452 | * 11/1982 |
| JP | 62-201254 | 9/1987 |
| JP | 64-20150 | 1/1989 |
| JP | 64-20151 | 1/1989 |
| JP | 64-20152 | 1/1989 |
| JP | 08-15629 | 1/1996 |

* cited by examiner

*Primary Examiner*—John Barlow
*Assistant Examiner*—Michael S Brooke
(74) *Attorney, Agent, or Firm*—Fitzpatrick, Cella, Harper & Scinto

(57) ABSTRACT

An ink jet recording head comprises a resistive heat generating element; and a non-linear type element having MIM type current voltage characteristics that present the resistive value thereof being higher at the time of applying lower voltage than the resistive value at the time of applying higher voltage for driving the resistive heat generating element without depending on polarity. Here, the resistive heat generating element and the non-linear type element are connected in series. For this ink jet recording head, the resistive heat generating element and the non-linear type element are both contributive to the generation of bubbles for discharging ink. Hence, in addition to heat generated by the resistive heat generating element for bubbling ink in the ink flow paths, the thermal energy generated by the non-linear type element, which has been discarded as heat loss conventionally, is utilized so as to prevent the reduction of the efficiency of the ink jet recording head.

20 Claims, 7 Drawing Sheets

INK JET RECORDING HEAD, INK JET RECORDING APPARATUS, AND INK JET RECORDING METHOD

BACKGROUND OF THE INVENTION

1. Field of the Invention

The present invention relates to an ink jet recording head applicable to a bubble jet printer that utilizes bubbling phenomenon. The invention also relates to an ink jet recording apparatus and an ink jet recording method.

2. Related Background Art

Conventionally, the recording head applicable to the bubble jet recording method is generally provided with fine discharge ports, flow paths, and heat generating elements each installed on a part of each of the flow paths. respectively. The bubble jet recording method is a recording method in which each heat generating element is used to heat liquid locally in each flow path to a high temperature so as to generate each bubble, and then, by utilization of the high pressure exerted at the time of bubbling, liquid is discharged from each of the fine discharge ports to enable liquid to adhere to a recording medium, such as recording paper sheet, for recording.

In order to record the image to be recorded more precisely and colorfully by means of the recording technology of the kind, it is necessary to adopt the related technology and technique so that extremely fine liquid droplets should be discharged in higher density. Here, then, the fundamental importance is that extremely fine flow paths should be formed together with extremely fine heat generating sources. With this in view, making the best use of the simple structure of a bubble jet recording method, the method for manufacturing a head in high density has been disclosed in the specification of Japanese Patent Laid-Open Application No. 8-15629, for example. This disclosed method effectively adopts the technologies of photolithographic process for utilization. Also, there is disclosed in the specification of Japanese Patent Laid-Open Application 62-201254, the heat generating element which provides a larger heating amount on the central portion than the heat amount on each of the end portions thereof in order to adjust the discharge amount of liquid droplets effectively. Usually, the heat generating element uses a resistive member formed by tantalum nitride thin film in a thickness of approximately 0.05 $\mu$m. Then, when this film is energized, liquid is bubbled by the application of Joule heat. A resistive heat generating element of the kind is usually provided with a cavitation proof layer formed by metal, such as Ta, in a thickness of approximately 0.2 $\mu$m, which is arranged through an insulating member, such as SiN in a thickness of approximately 0.8 $\mu$m, in order to prevent the surface of the resistive heating member from being damaged due to cavitation.

Also, in the specification of Japanese Patent Laid-Open Application No. 64-20150, a multiple nozzle ink jet recording head is disclosed, which is characterized in that there are arranged on a plurality of vertical wires and a plurality of intersecting points on a base plate, the rectifying members each allowing the forward current to flow, and each of the heat generating elements connected therewith, respectively. Also, in the specification of Japanese Patent Laid-Open Application 57-36679, there is disclosed a thermal head on which a plurality of diodes are arranged in a array to be able to generate heat by electricity charged in the forward direction.

SUMMARY OF THE INVENTION

In general, the ink jet recording head of bubble jet type uses a larger electric current than that of other type in order to generate bubbles for discharging ink. As a result, it is easier for this type of head to generate relatively large noise voltage. However, in the case of the ink jet recording head disclosed in the specification of Japanese Patent Laid-Open Application 64-20150 referred to above, current flows in the forward direction of rectifying element even for the rectifying element and heat generating element which are not driven at that time, there should occur the noise voltage or the like having unstable polarity, such as the voltage lower than the driving voltage of the heat generating element. Consequently, unwanted heating is generated by the heat generating element which is connected with such rectifying element or such heat generating element, hence making it impossible to record high quality images stably in some cases.

Also, many of the conventional ink jet recording heads are produced on condition that heat generating elements, diodes, and logic circuits are produced on a silicon substrate by means of semiconductor process (such as ion injection method). Therefore, an ink jet recording head having a relatively small number of nozzles can be made compact, and there is an advantage that the head can be produced in a simple one process. However, in the case of a multiple head, for example, a length of 12 inches is needed if the multiple head should be produced integrally in order to cover the sheet fully in the widthwise direction, for example. It is made difficult to use any usual silicon wafer, and there is a fear that the manufacturing costs become extremely high.

Under the circumstances, therefore, if the heat generating elements for BJ (bubble jet) recording use are driven in matrix by use of each of the non-linear type elements which is independent of polarity, but capable of providing the MIM type current voltage characteristics that present a higher resistive value at the application of low voltage than the resistive value at the application of high voltage, and which can be manufactured without depending on the conventional semiconductor process, such as ion injection method. There is then a possibility that an elongated ink jet recording head is manufactured with the capability of recording images in high quality stably without generating unwanted heat.

Therefore, the inventors hereof have proposed with the U.S. application Ser. No. 09/586,890 an ink jet recording head provided with the heat generating elements for BJ recording use, which can be driven in matrix using the MIM (Metal Insulator Metal) elements. For this head, the MIM elements, which are non-linear type elements, are provided corresponding to a plurality of heat generating elements for BJ recording use. However, there is a need for dealing with the concentration of electric power of approximately 0.1 $GW/m^2$ or more for the resistive heat generating elements of the heater portion of the recording head for BJ use. Then, the resistive heat generating elements connected in series with the MIM elements should be provided with such electric power, the supply of which has never been experienced for the products having the conventional MIM elements adopted as the non-linear type elements for use of matrix driving. There is then a fear that the efficiency of energy utilization is reduced due to the loss of electric power of the MIM elements themselves when a large electric power should be supplied to the resistive elements arranged in the form of array in high density.

Such loss of electric power of the MIM elements themselves is extremely small for the conventional products that use MIM elements like the liquid crystal or some others, and any serious problem has never been encountered in the art so far. Here, it is considered that this power loss of MIM elements themselves is a problem characteristic of the MIM elements to be used for the BJ recording that should deal with the supply of a large electric power.

Now, therefore, the present invention aims at the provision of an elongated but inexpensive ink jet recording head which is capable of preventing the energy utilization efficiency from being reduced due to the loss of electric power of non-linear type elements themselves. It also aims at the provision of an ink jet recording apparatus, as well as an ink jet recording method.

In order to achieve these objectives, an ink jet recording head of the present invention comprises a resistive heat generating element; and a non-linear type element connected to said resistive heat generating element and having MIM type current voltage characteristics presenting the resistive value thereof being higher at the time of applying lower voltage than the resistive value at the time of applying higher voltage for driving said resistive heat generating elements without depending on polarity. For this ink jet recording head, the resistive heat generating elements and the non-linear type elements are both contributive to the generation of bubbles for discharging ink.

The ink jet recording head of the invention thus structured makes it possible to enable not only the resistive heat generating elements to generate Joule heat when energized, but also, to make the non-linear type elements contributive to bubbling for discharging ink, which are connected with the resistive heat generating elements, respectively, to provide the MIM type current voltage characteristics presenting higher resistive value at the time of low voltage application than the resistive value at the time of high voltage application without depending on polarity. In other words, in addition to heat generated by the resistive heat generating elements for bubbling ink in the ink flow paths, the thermal energy generated by the non-linear type elements, which has been discarded as heat loss conventionally, is utilized for the ink jet recording head to prevent the reduction of its efficiency.

Further, the ink jet recording head of the resent invention may be the one in which each of the resistive heat generating element and each of the non-linear type element connected in series generate bubbles individually almost at the same timing or generate bubbles individually at different timing when electric power is supplied. Also, each of the resistive heat generating element and each of the non-linear type element connected in series may be arranged to generate one bubble when electric power is supplied.

Also, the ink jet recording head of the invention may be arranged to make only the resistive heat generating elements contributive to the generation of bubbles with electric power being supplied to the resistive heat generating element and the non-linear type element. In this case, the discharging amount of ink can be made in a multiple value.

Also, each of the resistive heat generating element and each of the non-linear type element connected in series are arranged substantially in parallel to the ink discharging direction or substantially perpendicular to the ink discharging direction.

Also, a unit having the resistive heat generating element and the non-linear type element connected in series may be arranged on an intersecting point of the matrix circuit formed by the scanning electrodes to input selection potential waveforms being intersected with the information electrodes to input information potential waveforms in accordance with image signals.

Also, the ink jet recording head may be provided with matrix electrodes to structure the matrix circuit for applying voltage to the resistive heat generating element and the non-linear type element connected in series.

Also, the resistive heat generating element and the non-linear type element may be arranged on the intersecting points of the matrix electrodes.

Also, the ink jet recording head of the present invention may be one that discharges ink by generating film boiling in ink with thermal energy generated on the resistive heat generating element and the non-linear type element.

Also, the ink jet recording apparatus of the invention comprises an ink jet recording head provided with a resistive heat generating element; and a non-linear type element connected to said resistive heat generating element in series and having MIM type current voltage characteristics presenting the resistive value thereof being higher at the time of applying lower voltage than the resistive value at the time of applying higher voltage for driving the plurality of resistive heat generating elements without depending on polarity, and carrying means for carrying a recording medium. For the ink jet recording apparatus, the aforesaid ink jet recording head is capable of enabling both the resistive heat generating element and the non-linear type element to be made contributive to the generation of bubbles for discharging ink, being provided with discharge ports to face the resistive heat generating element and the non-linear type element for discharging ink to the surface of a recording medium. Then, this ink jet recording apparatus is provided with a controlling portion for controlling electric power to be supplied to the resistive heat generating element connected in series and the non-linear type element.

The ink jet recording apparatus structured as described above is provided with the ink jet recording head of the present invention, as well as with the controller to control the supply of electric power to the non-linear type elements and the resistive heat generating elements of the ink jet recording head. Therefore, in addition to heat generated by the resistive heat generating elements for bubbling ink in the ink flow paths, the thermal energy generated by the non-linear type elements, which has been discarded as heat loss conventionally, is utilized for the ink jet recording head to prevent the reduction of its efficiency.

Further, for the ink jet recording apparatus of the invention, each of the resistive heat generating elements and each of the non-linear type elements connected in series may be arranged to generate bubbles individually almost at the same timing or at different timing with electric power being supplied for the contribution to the generating bubbles.

Also, for the ink jet recording apparatus of the invention, the controlling portion controls electric power to be supplied to the resistive heat generating element and the non-linear type element connected in series, and may be arranged to control whether both the resistive heat generating elements and the non-linear type elements connected in series, respectively, are made contributive to the generation of bubbles or only the resistive heat generating elements are made contributive to the generation of bubbles. In this case, the amount of ink discharges can be controlled in a multiple value with the execution of the control of the kind.

The ink jet recording method of the present invention is an ink jet recording method which uses the ink jet recording apparatus of the present invention, and comprises the step of recording by discharging ink from the ink jet recording head for the adhesion thereof to the recording surface of the recording medium.

As described above, the ink jet recording method of the invention comprised the step of discharging ink from the discharge ports of the ink jet recording head of the invention so as to record on a recording medium with the adhesion of ink thereon. In other words, in addition to heat generated by the resistive heat generating elements for bubbling ink in the ink flow paths, the thermal energy generated by the non-linear type elements, which has been discarded as heat loss conventionally, is utilized for the ink jet recording head to prevent the reduction of the recording efficiency thereof, hence making it possible to reduce the costs needed for recording.

Further, the ink jet recording method of the invention may be arranged so that with the supply of electric power to the resistive heat generating element connected in series and the non-linear type element, these elements are made contributive to generating bubbles individually almost at the same timing or to generating bubbles individually at different timing.

Also, the ink jet recording method of the invention may be arranged so that with the supply of electric power to the resistive heat generating element and the non-linear type element connected in series, only the resistive heat generating elements are made contributive to generation of bubbles. In this case, with the combination of the recording method in which bubbles are generated individually by the resistive heat generating element and the non-linear type element as described above, it becomes possible to arrange the amount of ink discharge in a multiple value.

DESCRIPTION OF THE PREFERRED EMBODIMENTS

Next, with reference to the accompanying drawings, the description will be made of the embodiments in accordance with the present invention.

Figure 1:
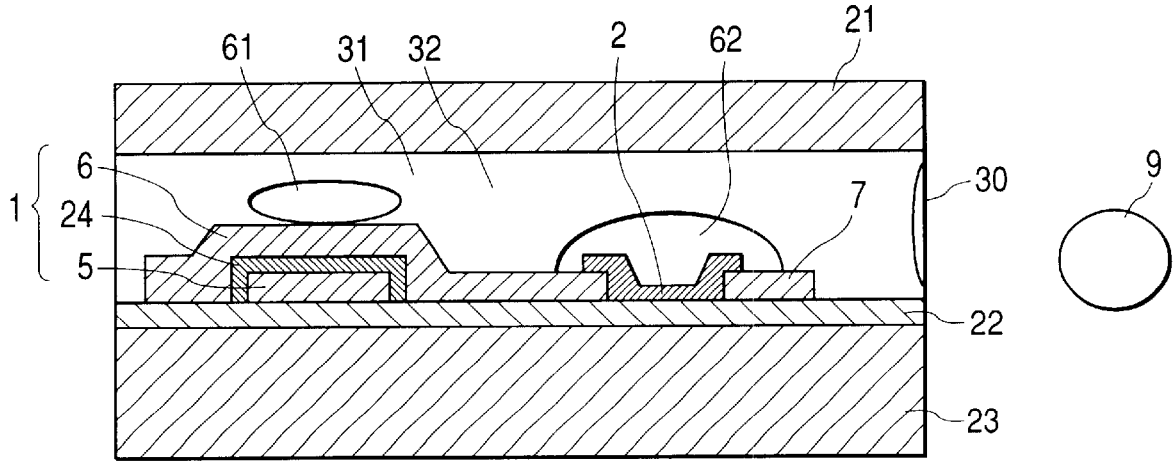
FIG. 1 is a side sectional view which shows schematically an ink jet recording head in accordance with a first embodiment of the present invention.
Figure 2:
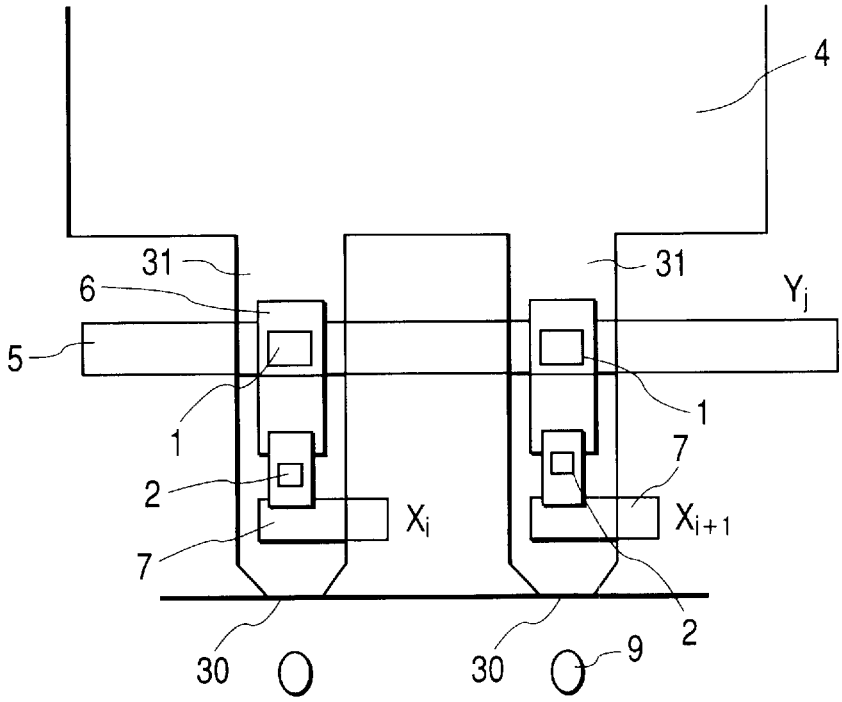
FIG. 2 is a plan view which schematically illustrates the structure of the ink jet recording head represented in FIG. 1, and the structure of the circuit thereof.
Figure 3:
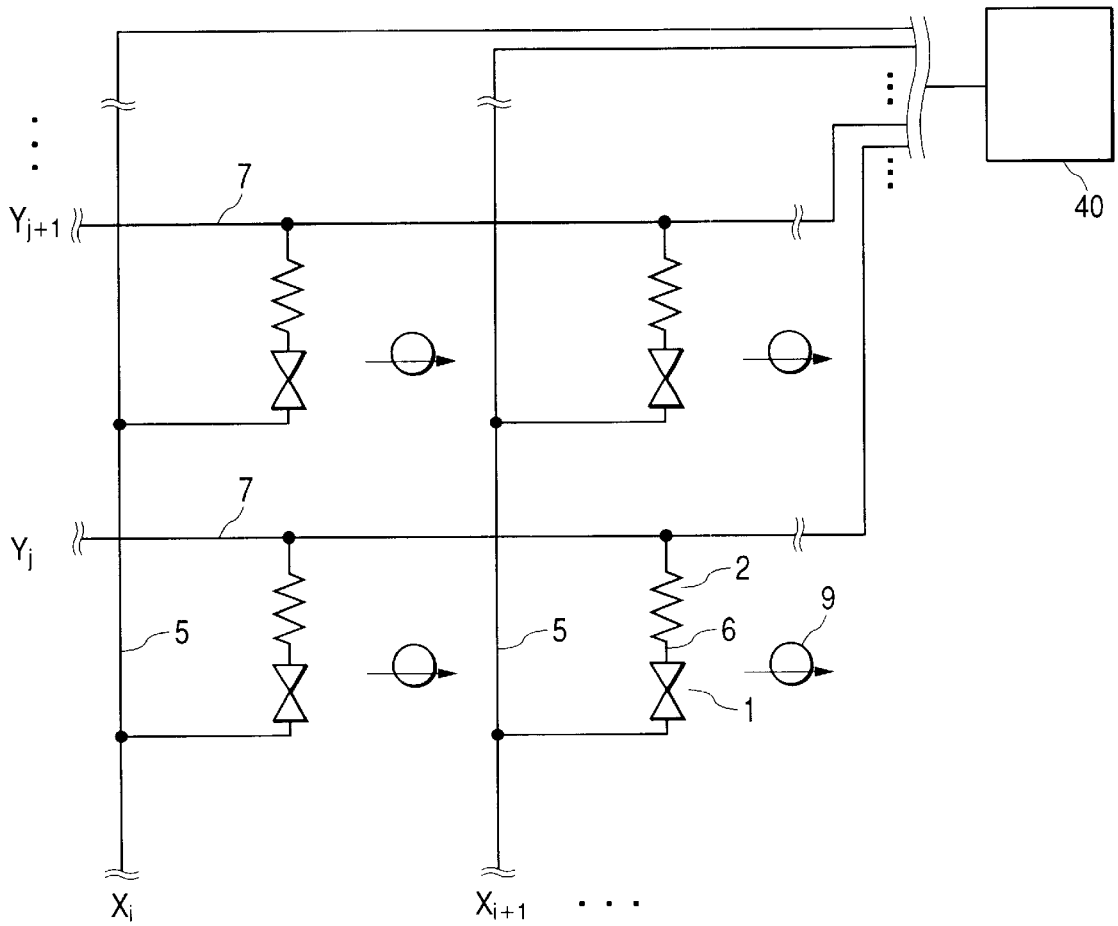
FIG. 3 is a circuit diagram which illustrates the conception of the matrix circuit of the ink jet recording head represented in FIG. 1.

FIG. 1 is a side sectional view which shows schematically an ink jet recording head in accordance with a first embodiment of the present invention. FIG. 2 is a plan view which schematically illustrates the structure of the ink jet recording head and the structure of the circuit thereof in accordance with the present embodiment. FIG. 3 is a circuit diagram which illustrates the conception of the matrix circuit of the ink jet recording head of the present embodiment.

The ink jet recording head is provided with the non-linear type element 1, such as MIM element, and the resistive heat generating element 2 which generates Joule heat when energized in the flow path 31 which is formed by the base plate 23 having the lower layer 22 formed on the upper face thereof, and the ceiling plate 21 arranged to face the base plate 23. These structural members are arranged in the form of matrix. Also, for the ink jet recording apparatus to be described later, a controller 40 is provided to control voltage or the like to be applied to the non-linear type elements 1 and the resistive heat generating elements 2.

The non-linear type element 1 comprises a lower side information electrode 5 installed on the lower layer 22 in order to input the information potential waveforms for discharging use or non-discharging use in accordance with image signals; the upper side electrode 6 which is conducted to the resistive heat generating element 2, too; and the insulating thin film 24 which insulates the lower side information electrode 5 form the upper side electrode 6. The resistive heat generating element 2 is electrically connected with the scanning electrode 7 and the upper side electrode 6. For the ink jet recording head of the present embodiment, the non-linear type element 1 is arranged on the side nearer to the common liquid chamber 4 which supplies ink to the flow path 31, and the resistive heat generating element 2 is arranged on the side nearer to the discharge port 30.

In the circuit structure sown in FIG. 3, the scanning electrodes 7 are arranged in the line direction $Y_j$, $Y_{j+1}$ . . . , and the lower side information electrodes 5 are arranged in the column direction $X_i$, $X_{i+1}$ . . . , thus structuring the matrix circuit. As shown in FIG. 3, for the ink jet recording head of the present embodiment, the non-linear type element 1 and the resistive heat generating element 2 are connected in series by means of the upper side electrode 6 on the intersecting point of the lower side information electrode 5 and the scanning electrode 7 of the matrix circuit formed by the $Y_j$, $Y_{j+1}$ . . . , $X_i$, $X_{i+1}$ . . .

The controller 40 controls the non-linear type element 1 to be turned on or off in accordance with the image signals by inputting the selective potential waveforms into the scanning electrode 7, and the information potential waveforms for discharging use or non-discharging use into the lower side information electrode 5 in accordance with the image signals, and then, controls discharges and non-discharges of discharging droplets 9 from the discharge port 30. In other words, the discharge liquid droplet 9 is discharged from only the discharge port 30 that corresponds to the non-linear type element 1 which is controlled to be turned on. Further in detail, the discharging liquid 32, which is on the resistive heat generating element 2 having electric power supplied when the non-linear type element 1 is controlled to be turned on or on the non-linear type element 1, is rapidly heated, thus generating bubbles 61 and 62. These bubbles 61 and 62 are bubbles based on the film boiling phenomenon, and generated on the enter surface region of the heating element along with extremely high pressure at once. With the pressure thus exerted, the discharging liquid 9 is discharged from the discharge port 30 in the direction substantially in parallel to the arrangement direction of the non-linear type element 1 and the resistive heat generating element 2, thus forming images on a recording medium.

Figure 4:
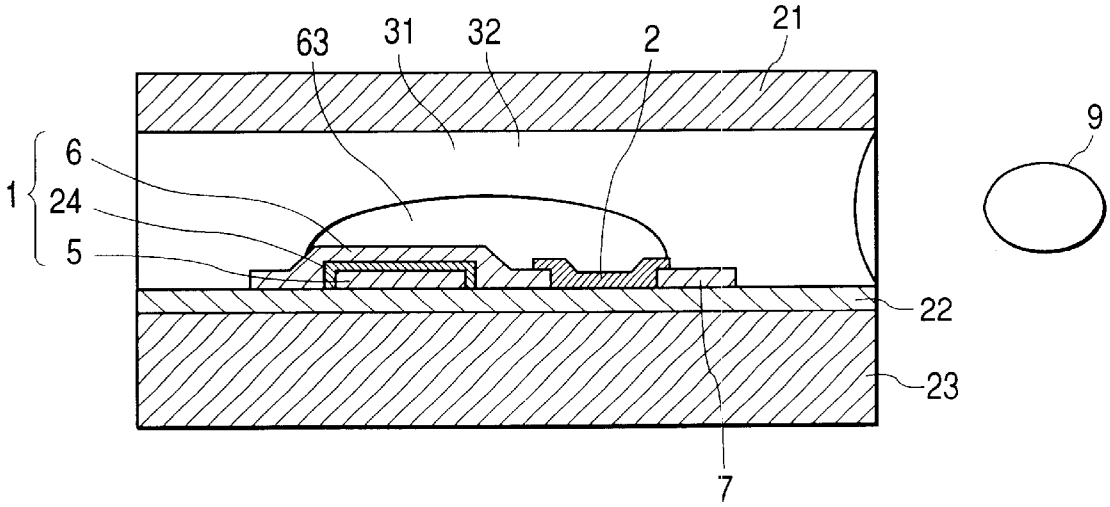
FIG. 4 is a side sectional view which shows schematically another ink jet recording head in accordance with the first embodiment of the present invention.

Also, for the present invention, when the non-linear type element 1 and the resistive heat generating element 2 are closely located as shown in FIG. 4, what contributes to bubbling includes the generation of one bubble 63 using the non-linear type element 1 and the resistive heat generating element 2.

In other words, for the present invention, what contributes to the generation of bubble means the provision of thermal energy for ink, which enables the non-linear type element 1 and the resistive heat generating element 2 to generate the bubbles 61 and 62 each individually, and also, means the provision of thermal energy for ink, which enables each of the non-linear type element 1 and the resistive heat generating element 2 to utilize the thermal energy generated by them respectively for the generation of one bubble. In this respect, in order to discharge the discharging liquid 9 more stably, it is preferable to generate bubbles by means of film boiling phenomenon.

As described above, for the ink jet recording head of the present embodiment, not only the resistive heat generating element 2 is made contributive to the generation of bubbles, but also, the resultant heating generated by the non-linear type element 1 connected with the resistive heat generating element 2 in series, which is the switching member for use of turning on and off the resistive heat generating element 2, is positively utilized for the bubbling of discharging liquid 32. In this manner, it becomes possible to prevent the effectiveness of energy utilization from being reduced by the loss of electric power of the non-linear type element 1 itself.

Here, the MIM element is, in the original meaning thereof, the tunnel junction element provided with the insulator which is arranged to be sandwiched by metallic materials. Usually, however, the junction element which has insulator and conductive electrodes arranged to sandwich the insulator is also called the MIM element.

For the electric conduction mechanism in the insulator of the MIM element, there has been known the hopping type electric conduction in which tunneling is repeated in plural numbers in a insulator, such as Poole-Frenkel type conduction, or the relatively simple tunnel conduction, such as Fowler-Nordheim type conduction, among some others.

For the tunnel current of the kind to flow so that current flows in a junction element, the distance across electrodes should be extremely small. The critical film thickness of an insulator to allow current to flow in the MIM element or the critical gap between electrodes largely depends on the kind of insulating material, the kind of electrode material, or the conduction mechanism. It is desirable, however, to set the gap between electrodes at 100 nm or less, for example, in order to enable useful current to flow as an MIM element. Further, preferably, to obtain a large current at a low voltage needed for driving a bubble jet recording head, it is desirable to set the gap between electrodes at 40 nm or less.

Also, if the gap between electrodes is set to be extremely small, there is a fear that ion on the metallic surfaces of electrodes causes the field emission. Therefore, it is desirable to set the gap between electrodes at 1 nm or more. Further, it is desirable to set the gap between electrodes at 4 nm or more in order to obtain the tunnel junction which generates stable tunnel conduction.

In other words, it is particularly preferable to use the MIM element as the non-linear type element 1 with the distance across electrodes thereof being 1 nm or more and 100 nm or less, or more preferably, 4 nm or more and 40 nm or less.

Also, the so-called varistor, which is formed by arranging, in place of the insulator, the sintered layer having metal oxide, such as the one having Bi, Pr and Co or the like added to ZnO or the granular crystal layer formed SiC or the like across electrodes of the aforesaid MIM element, is an element that has the current voltage characteristics of the MIM type which presents low resistive value on the high voltage side and high resistive value on the low voltage side without depending on the polarity. Therefore, in the same manner as the MIM element, this varistor can be used as the non-linear type element 1 of the present invention.

Using the non-linear type element 1 that presents the current voltage characteristics of MIM type it becomes possible to prevent the generation of unwanted heating from the non-linear type element 1, because due to the large resistive value of the non-linear type element 1, almost no current flows in the non-linear type element 1 at the time of lower voltage application even if the voltage, such as noise voltage, is applied at the value which should be lower than the driving voltage of the heating element. Also, the electric energy which is generated for driving a desired non-linear type element 1 is consumed by the unwanted heating of other non-linear type element 1 to make the inputted electric energy to drive the non-linear type element 1 smaller so as not to allow the desired bubbling to be generated. Consequently, the liquid discharging amount is caused to change, and the image quality of recorded image is prevented from being disturbed.

Figure 5:
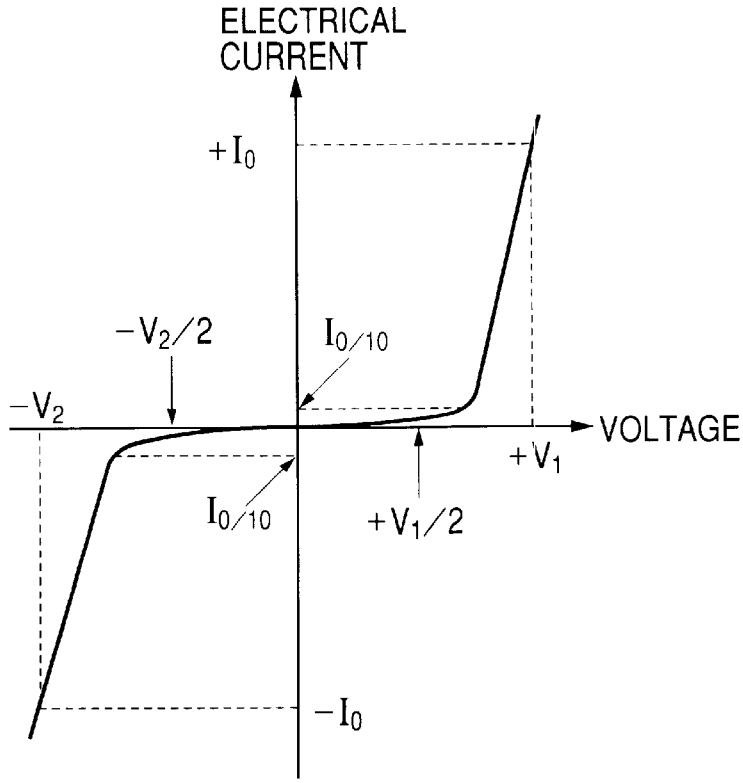
FIG. 5 is a view which shows the electrical current and voltage characteristics of the ink jet recording head in accordance with the first embodiment of the present invention.

Particularly for the ink jet recording head of bubble jet type to which the present invention is applicable, a relatively large electric current is used as compared with other types in order to generate bubbles. As a result, noise voltage is tends to occur. Therefore, in order not to cause the noise voltage, which presents irregular polarity, the non-linear type element 1 to generate heating, it is desirable to set the characteristics of the current voltage for the non-linear type element 1 so that only a sufficiently small current is allowed to flow both on the positive voltage side and negative voltage side when the applied voltage has a small absolute value. Here, therefore, it is particularly desirable to set the characteristics of the current voltage for the non-linear type element 1 so that, as shown in FIG. 5, the ratio of the absolute values of the applied voltage, $+V_1$ and $-V_2$ ($V_1/V_2$), is a value of 0.5 to 2.0 that gives the current of $I_0$ equivalent to the current that runs at the time of voltage application for generating desired bubbling, and then, the absolute value is set at $I_0/10$ or less for the current that flows at the applied voltages of $+V_1/2$, and $-V_2/2$.

When the non-linear type element 1 that presents the characteristics of MIM type current voltage is arranged on each intersecting point of the matrix electrodes, it becomes possible to perform the matrix driving of each heating element, while suppressing the unwanted heating due to bias voltage at non-selective point at the time of matrix driving. Also, with the matrix driving, it becomes easier to separate the driver and the heating element. There is then the effect that even a large-scale production is made possible by use of inexpensive non-Si base plate.

Figure 6:
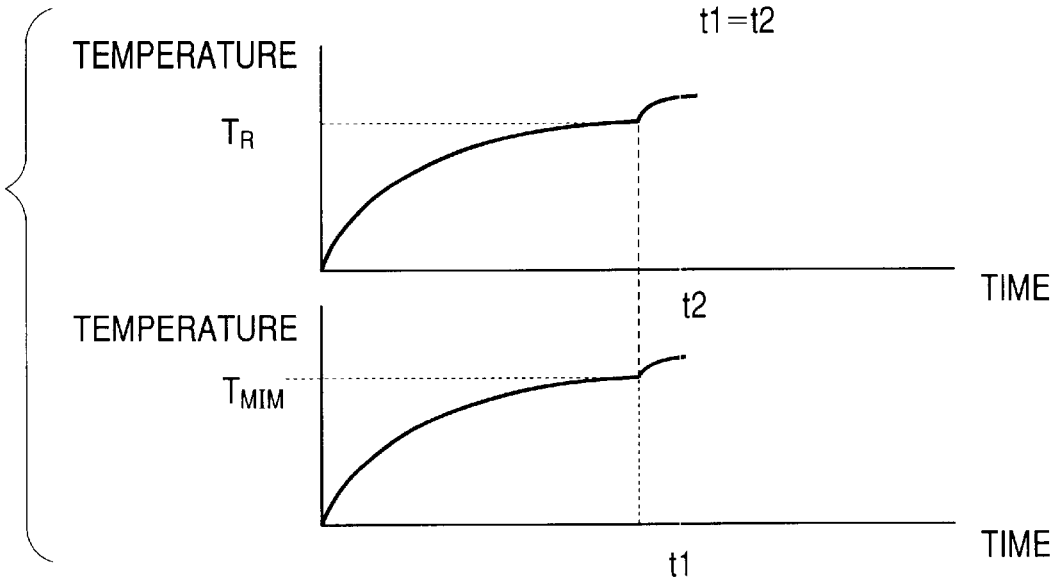
FIG. 6 is a graph which shows each of the qualitative temperature changes on the interface between each of the heat generating elements and discharging liquid when the non-linear type element and the resistive heat generating element arrive at the temperature of bubbling the discharging liquid almost at the same time.

Next, FIG. 6 shows the time series quantitative changes of the temperature $T_{MIM}$ at the interface between the non-linear type element and discharging liquid, and the temperature $T_R$ at the interface between the resistive heat generating element and discharging liquid when electric power is applied from the controller.

The non-linear type element 1 and the resistive heat generating element 2 indicate the same characteristics of temperature rise. Then, both the non-linear type element 1 and the resistive heat generating element 2 arrive at the bubbling temperature at the same time t1 and t2. As a result, the bubbling at the non-linear type element 1 and the that of the resistive heat generating element 2 are substantially the same. In other words, the provision of energy needed for discharging the discharging liquid 9 is made not only by the non-linear type element 1, but also, made by the resistive heat generating element 2. In this way, it becomes possible to prevent the efficiency of energy utilization from being reduced due to the loss of electric power of the non-linear type element 1 itself, which is caused if the non-linear type element 1 is energized alone.

Also, it is possible to control bubbling to be on both the bubbling surfaces of the non-linear type element 1 and the resistive heat generating element 2 or to be only on the bubbling surface of either one of them by structuring the ink jet recording head of the present embodiment with the non-linear type element 1 and the resistive heat generating element 2, the bubbling threshold voltages Vth1 and Vth2 of which differ from each other or by enabling the controller 40 to control the voltage to be applied to the intersecting points of the matrix circuit. In other words, with an appropriate changes of the pulse width or pulse height of the voltage to be applied to the non-linear type element 1 and the resistive heat generating element 2, it becomes possible to control bubbling to be made only by the resistive heat generating element 2 or to be made both by the resistive heat generating element 2 and the non-linear type element 1. In this way, the discharging amount can be controlled in multiple values.

Figure 7:
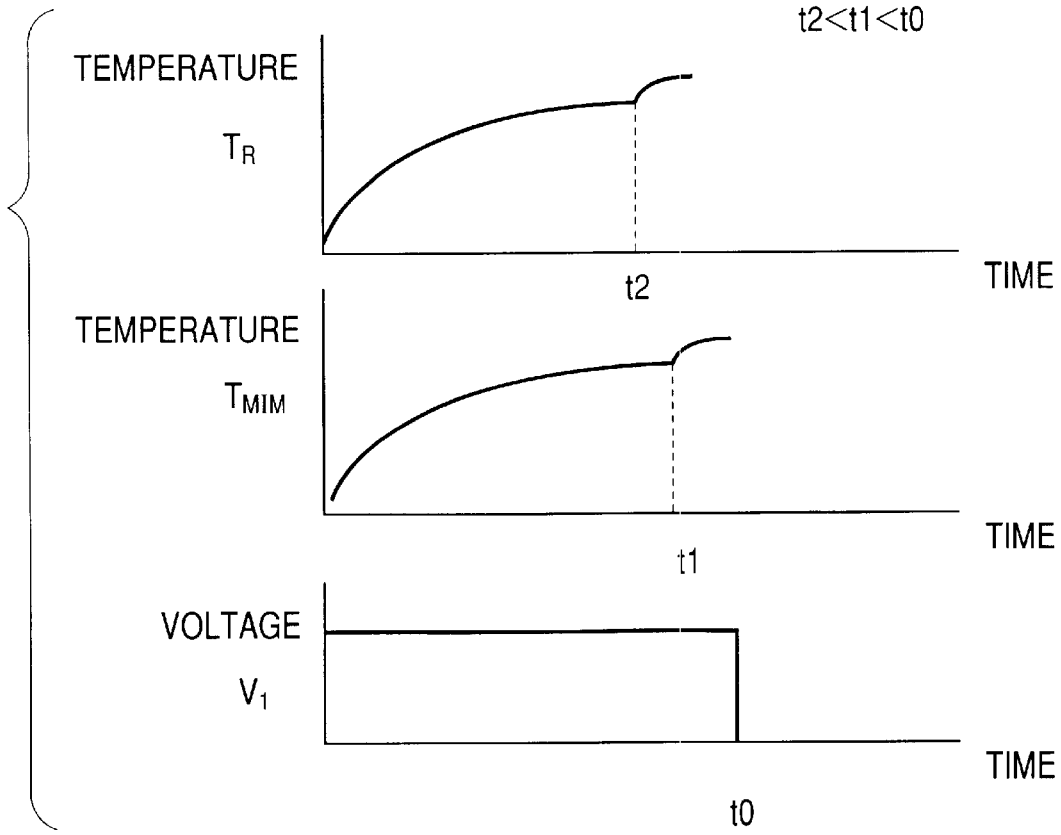
FIG. 7 is a graph which shows each of the qualitative temperature changes on the interface between each of the heat generating elements and discharging liquid when the non-linear type element arrives at the temperature of bubbling the discharging liquid earlier than the resistive heat generating element.
Figure 8:
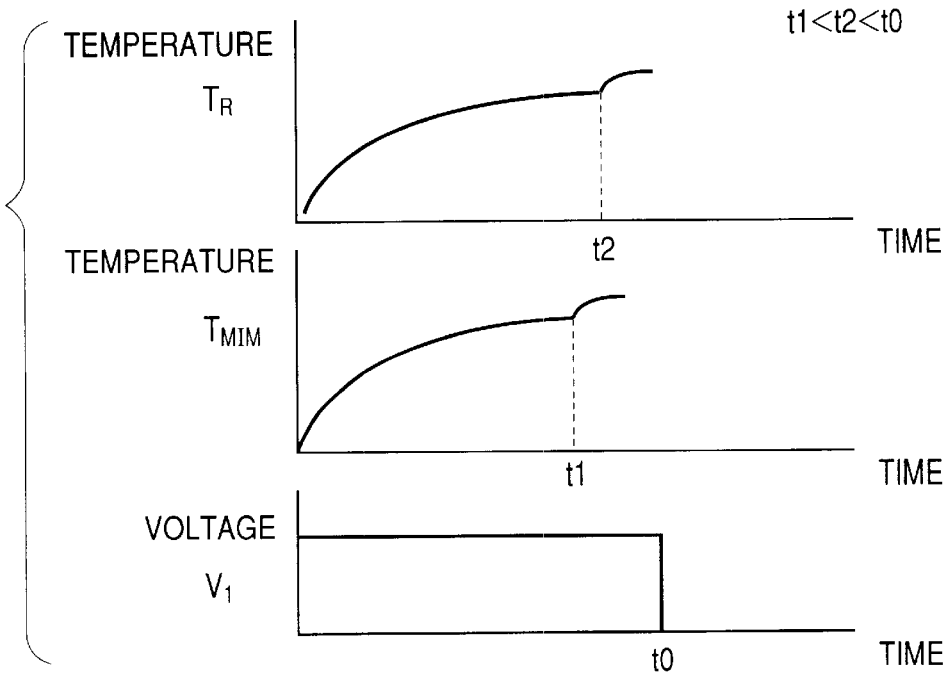
FIG. 8 is a graph which shows each of the qualitative temperature changes on the interface between each of the heat generating elements and discharging liquid when the resistive heat generating element arrives at the temperature of bubbling the discharging liquid earlier than the non-linear type element.

For example, as shown in FIG. 7, the structure may be arranged so that when the voltage V1 is applied by use of the controller 40 for a period of time t0, the temperature $T_R$ at the interface between the resistive heat generating element 2 and discharging liquid 32 arrives at the bubbling temperature in the time t2 at first, and then, the temperature $T_{MIM}$ at the interface between the non-linear type element 1 and discharging liquid 32 arrives at the bubbling temperature in the time t1, hence being in the status of (t1<t2<t0) to enable the resistive heat generating element 2 side to be bubbled earlier and the non-linear type element 1 side to be bubbled in continuation. Or, conversely, as shown in FIG. 8, the structure may be arranged to control the status to be t2<t1<t0 so that the non-linear type element 1 side is bubbled earlier, and then, the resistive heat generating element 2 side is bubbled.

Figure 9:
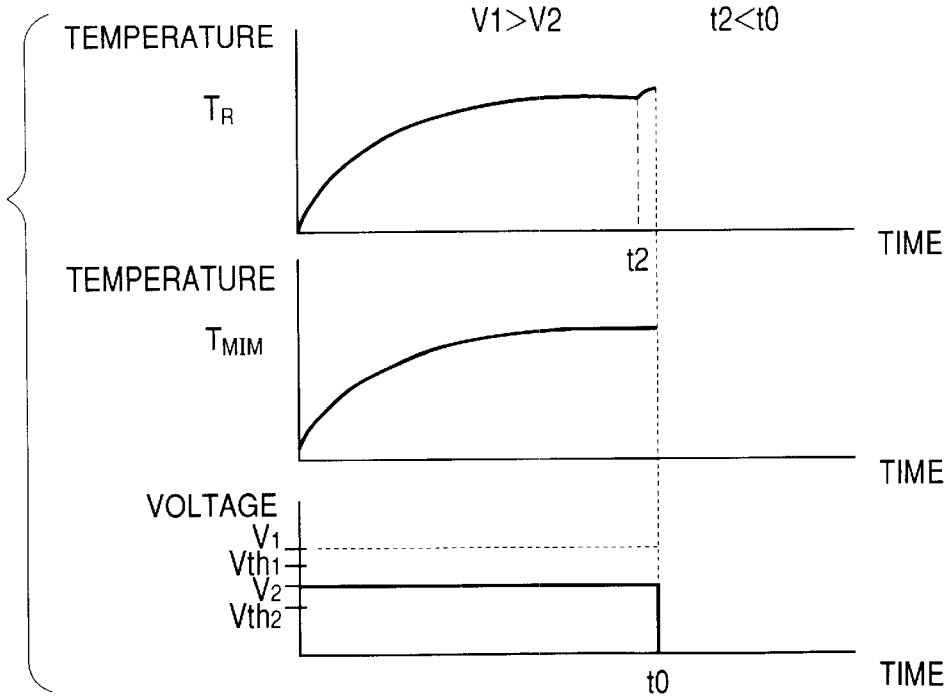
FIG. 9 is a graph which shows each of the qualitative temperature changes on the interface between each of the heat generating elements and discharging liquid when only the resistive heat generating element arrives at the temperature of bubbling the discharging liquid.

Further, as shown in FIG. 9, when the voltage V2 and voltage V1 should be applied, it may be possible to arrange them to be in a relationship of V2<V1, and set the V2 to be lower than the threshold voltage Vth1 for bubbling liquid on the non-linear type element 1, and also, set it at a value higher than the threshold value Vth2 at which liquid bubbles on the resistive heat generating element 2 so as to enable bubbles to be generated only on the resistive heat generating element 2 portion. In this case, if the bubbling mode is such as to enable bubbles to be communicated with the air outside, the discharging liquid 32 is bubbled only on the resistive heat generating element 2 by the application of the voltage V2 as shown in FIG. 9. Therefore the liquid volume Vb, which is substantially in the front part of the resistive heat generating element 2 can be discharged, or, although not shown, it is possible to discharge liquid in the liquid volume Va (>Vb) substantially on the front part of the non-linear type element 1, because the discharging liquid 32 is bubbled both on the non-linear type element 1 and the resistive heat generating element 2 by applying the voltage V1 which is higher than the threshold voltage Vth1. Thus, the discharging amount can be controlled in a multiple value.

In this way, the ink jet recording head of the present embodiment can operate with almost simultaneous timing for the non-linear type element 1 and the resistive heat generating element 2 to generate thermal energy or with control to provide a time lag between them or to enable only the resistive heat generating element 2 to generate thermal energy.

As has been described above, in accordance with the ink jet recording head of the present embodiment, the thermal energy generated by the non-linear type element 1, which has been discarded conventionally as heat loss, can be used in addition to the heating by the resistive heat generating element 2 for bubbling the discharging liquid 32, hence making it possible for the ink jet recording head to prevent its efficiency from being lowered.

Also, with the structure in which the non-linear type 1, such as MIM element, is driven in matrix, which can be produced without depending the conventional semiconductor process, it becomes possible to provide an elongated recording head at lower costs.

(Second Embodiment)

Figure 10:
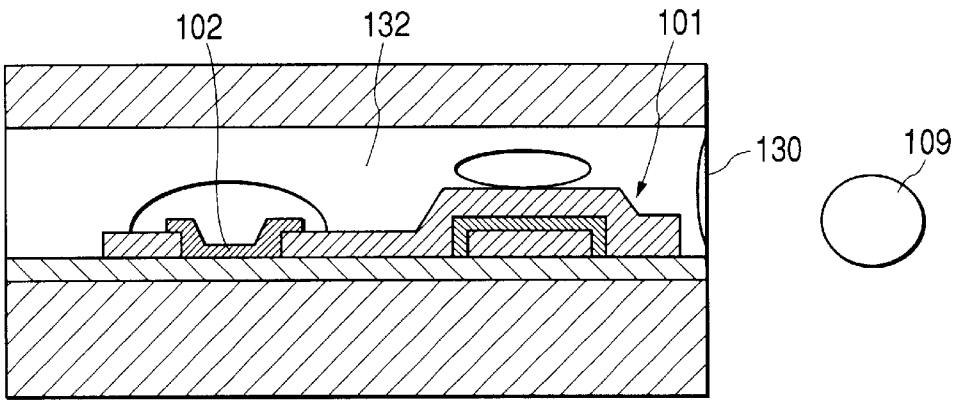
FIG. 10 is a side sectional view which shows schematically an ink jet recording head in accordance with a second embodiment of the present invention.

Next, FIG. 10 is a side sectional view which schematically shows an ink jet recording head in accordance with a second embodiment of the present invention.

For the ink jet recording head of the present embodiment, the non-linear type element 101 is arranged on the side nearer to the discharge port 130, and then, the resistive heat generating element 102 is arranged.

In other words, the arrangement of the non-linear type element 1 and the resistive heat generating element 2 for the ink jet recording head of the first embodiment is reversed here, but any other structures than this arrangement are fundamentally the same. Therefore the detailed description thereof will be omitted.

As described above, in accordance with the ink jet recording head of the present embodiment, the thermal energy generated by the non-linear type element 101, which has been discarded conventionally as heat loss, is used in addition to heating by the resistive heat generating element 102 for bubbling the discharging liquid 132 as in the case of the first embodiment, hence making it possible for the ink jet recording head to prevent its efficiency from being lowered.

Also, with the structure in which the non-linear type 101, such as MIM element, is driven in matrix, which can be produced without depending the conventional semiconductor process, it becomes possible to provide an elongated recording head at lower costs.

(Third Embodiment)

Figure 11:
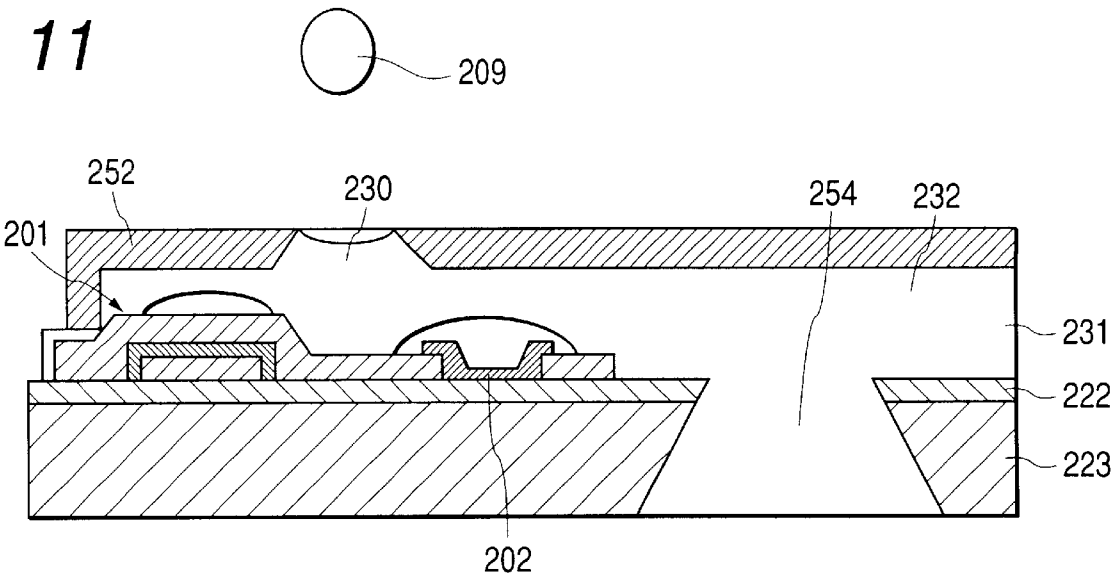
FIG. 11 is a side sectional view which shows schematically an ink jet recording head in accordance with a third embodiment of the present invention.

Next, FIG. 11 is a side sectional view which schematically shows an ink jet recording head in accordance with a third embodiment of the present invention.

For the ink jet recording head, the discharge port 230 for discharging the discharging liquid 209 is formed on the discharge port formation member 252 which is fixed to face the base plate 223 in order to form the flow path 231. Also, the discharge port 230 is formed in a position to face the gap between the non-linearly type element 201 and the resistive heat generating element 202 installed on the base plate 223 side.

Also, the discharging liquid supply port 254 for supplying the discharging liquid is formed on the base plate 223 by being penetrated through the lower layer 222 that corresponds to the lower wall of the flow path 231. The resistive heat generating element 202 is arranged on the side nearer to the discharge liquid supply port 254 than the non-linear type element 201.

In other words, the ink jet recording head of the present embodiment is structured to enable the discharging liquid droplet 209 to be discharged in the direction substantially perpendicular to the base plate 223. However, the fundamental structure thereof is the same as those described in accordance with the first and second embodiments. Therefore, the detailed description thereof will be omitted.

As described above, in accordance with the ink jet recording head of the present embodiment, the thermal energy generated by the non-linear type element 201, which has been discarded conventionally as heat loss, is used in addition to heating by the resistive heat generating element 202 for bubbling the discharging liquid 232 as in the cases of the first and second embodiments, hence making it possible for the ink jet recording head to prevent its efficiency from being lowered.

Also, with the structure in which the non-linear type 201, such as MIM element, is driven in matrix, which can be produced without depending the conventional semiconductor process, it becomes possible to provide an elongated recording head at lower costs.

(Third Embodiment)

Figure 12:
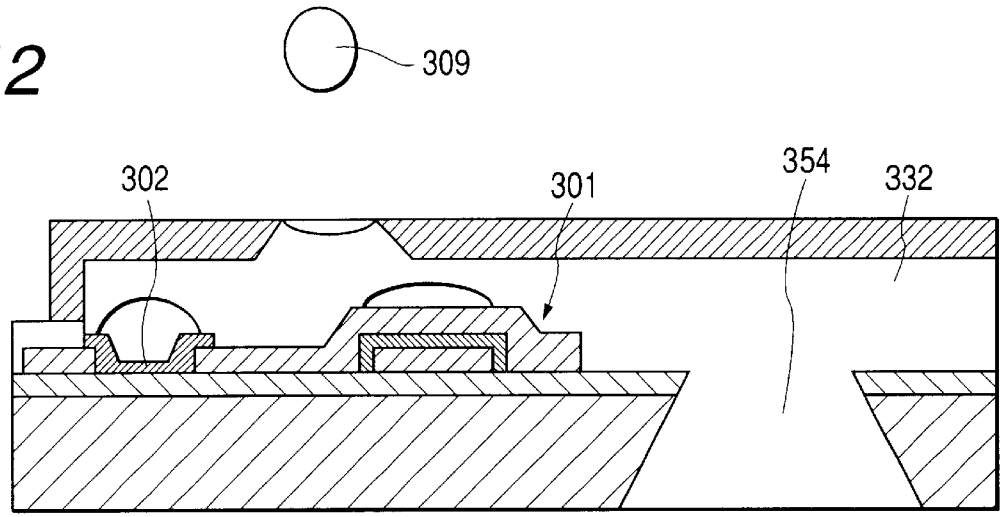
FIG. 12 is a side sectional view which shows schematically an ink jet recording head in accordance with a fourth embodiment of the present invention.

Next, FIG. 12 is a side sectional view which schematically shows an ink jet recording head in accordance with a fourth embodiment of the present invention.

For the ink jet recording head of the present embodiment, the non-linear type element 301 is arranged on the side nearer to the discharging liquid supply port 354, and the, the resistive heat generating element 302 is arranged. In other words, the arrangement of the non-linear type element 201 and the resistive heat generating element 202 of the ink jet recording head shown in the third embodiment is reversed here. Any other structure than this arrangement are fundamentally the same. The detailed description thereof, therefore, will be omitted.

As described above, in accordance with the ink jet recording head of the present embodiment, the thermal energy generated by the non-linear type element 301, which has been discarded conventionally as heat loss, is used in addition to heating by the resistive heat generating element 302 for bubbling the discharging liquid 332 as in the cases of the first to third embodiments, hence making it possible for the ink jet recording head to prevent its efficiency from being lowered.

Also, with the structure in which the non-linear type 301, such as MIM element, is driven in matrix, which can be produced without depending the conventional semiconductor process, it becomes possible to provide an elongated recording head at lower costs.

Figure 13:
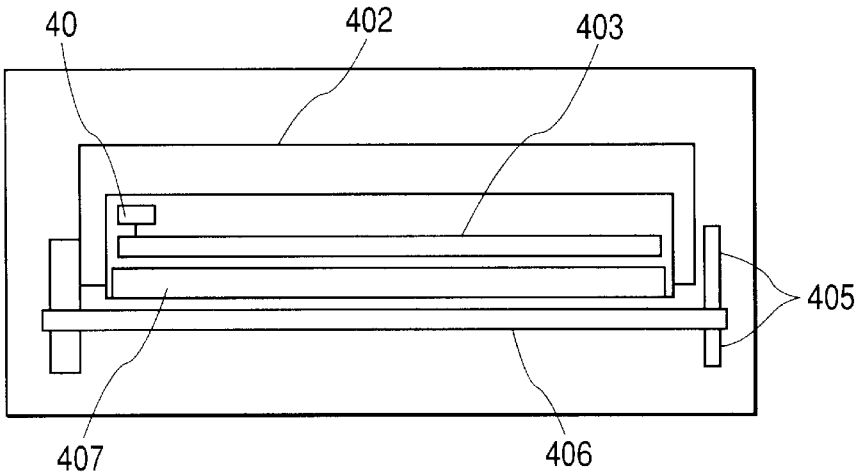
FIG. 13 is a view which schematically shows one example of the ink jet recording apparatus having mounted thereon the ink jet recording head of the present invention.

Next, FIG. 13 is a view which schematically shows one example of the ink jet recording apparatus on which is mounted an ink jet recording head described in each of the above embodiments.

This ink jet recording apparatus is structured to carry the paper sheet 406, which serves as a recording medium, by a sheet feeding roller 405 controlled by a driving circuit 403. Also, the ink jet recording head 407, which is controlled by a controller 40 shown in each of the embodiments described above, is arranged so that each of the discharge ports thereof faces the paper sheet 406 to be carried. Ink is discharged from each of the discharge ports in accordance with signals from the controller 40 to form images on the paper sheet 406. Ink is supplied from an ink tank 402 to the ink jet recording head 407.

In this respect, for the present invention, the description has been made of the first to fourth embodiments as example. It is to be understood that the invention is not necessarily limited thereto. Also, hereunder, the implemented examples are shown in accordance with the first and second embodiments. It is also to be understood that the resent invention is not necessarily limited to these examples.

IMPLEMENTED EXAMPLES (First Implemented Example)

Next, as a first implemented example of the present invention, the description will be made of the manufacture and characteristics of the ink jet recording head of the first embodiment described above. Here, the reference marks used in the description given below are the same as those applied to the first embodiment.

The non-linear type element 1 is MIM element, and on the insulating thin film 24 which is an oxidized insulation film obtainable by the anode oxidation of the metallic lower side information electrode 5, the metallic upper side electrode 6 is produced to intersect with the lower side information electrode 5. For the lower side information electrode 5 and the upper side electrode 6, Ta thin film is produced by means of RF sputtering method in a thickness of approximately 300 nm, and on the surface thereof is oxidized by means of the anode oxidation method to form the $Ta_2O_5$ insulating thin film 24 in a thickness of approximately 32 nm. At this juncture, the RF sputtering is performed in an Ar gas atmosphere of approximately 1.33 Pa. Also, the anode oxidation is performed in a citric acid solution of 0.8 wt % with a platinum electrode in mesh form. Also, the upper side electrode 6 and the scanning electrode 7 are Ta thin film electrodes in a thickness of approximately 23 nm. The base plate 23 is the Si substrate having the crystalline axis (111) in a thickness of 0.625 mm. The lower layer 22 is a Si thermo-oxidized film in a thickness of 2.75 $\mu$m. The resistive heat generating element 2 is a Ta nitride thin film in a thickness of 0.05 $\mu$m.

Also, the width of the flow path 31 is 40 $\mu$m. The size of the resistive heat generating element 2 is 29.1 $\mu$m×29.1 $\mu$m. The area of the resistive heat generating element 2 is 846.875 $\mu m^2$. The element resistance of the resistive heat generating element 2 is 53Ω. Also, the gap between each of the flow paths 31 is 40 $\mu$m. The size of the non-linear type element 1 is 29.1 $\mu$m×145.53 $\mu$m, the area of which is 4235 $\mu m^2$ in rectangular with the longitudinal direction thereof being the direction toward the discharge port. In this case, the area of the non-linear type element 1 is five times the area of the resistive heat generating element 2. Here, both ends of the non-linear type element 1, that is, the element resistance is 265Ω against the voltage 33.5 V to be applied across the lower side information electrode 5 and the upper side electrode 6.

Here, when a voltage of 40.2 V is applied across the lower side information electrode 5 and the scanning electrode 7, a voltage of 33.5 V is applied to the non-linear type element 1, and a voltage of 6.7 V is applied to the resistive heat generating element 2. Then, a current of 126 mA flows. At this juncture, the power dissipation of the non-linear type element 1 is 4.235 W which is converted into heat. The power dissipation of the resistive heat generating element 2 is 0.847 W which is converted into heat. Also, the concentration of electric power of the non-linear type element 1 is 1 $GW/m^2$, and the concentration of electric power of the resistive heating member 2 is 1 $GW/m^2$. Therefore, bubbling is possible not only on the resistive heat generating element 2, but on the surface where the non-linear type element 1 is in contact with the discharging liquid 32.

(Second Implemented Example)

For this implemented example, the description will be made of the manufacture and characteristics of the ink jet recording head of the first embodiment described above as in the case of the first implement example. Here, the reference marks used in the description given below are the same as those applied to the first implemented example. Also, The non-linear type element 1 in this implemented example is manufactured in the same manner as in the first implemented example. Then, the configuration and characteristics thereof, as well as the width of the flow path 31 and the gap between each of the flow paths are the same as those in the first implemented example. Therefore, the description thereof will be omitted.

The size of the resistive heat generating element 2 of this implemented example is 28 $\mu m \times 28\ \mu m$. The area of the resistive heat generating element 2 is 784 $\mu m^2$. The element resistance of the resistive heat generating element 2 is 53Ω.

In this case, the area of the non-linear type element 1 is 5.4 times the area of the resistive heat generating element 2. Then, both ends of the non-linear type element 1, that is, the element resistance is 265Ω against the voltage 33.5 V to be applied across the lower side information electrode 5 and the upper side electrode 6.

Here, when a voltage of 40.2 V is applied across the lower side information electrode 5 and the scanning electrode 7, a voltage of 33.5 V and a voltage of 6.7 V are applied to the non-linear type element 1 and the resistive heat generating element 2, respectively. Then, a current of 126 mA flows. At this juncture, the power dissipation of the non-linear type element 1 is 4.235 W which is converted into heat. The power dissipation of the resistive heat generating element 2 is 0.847 W which is converted into heat. Also, the concentration of electric power of the non-linear type element 1 is 1 $GW/m^2$, and the concentration of electric power of the resistive heating member 2 is 1.08 $GW/m^2$. Therefore, bubbling is possible not only on the resistive heat generating element 2, but on the surface where the non-linear type element 1 is in contact with the discharging liquid 32.

In this respect, for this implement example, the concentration of electric power of the non-linear type element 1 is smaller than the concentration of electric power of the resistive heating member 2, and the generating of bubbling by the non-linear type element 1 is temporally behind than that of bubbling by the resistive heat generating element 2.

(Other Embodiment)

In this respect, as described above, the present invention relates to a recording head, among those using the ink jet recording method, which is provided with means for generating thermal energy as energy to be utilized for discharging ink, and which adopts the method for creating the change of states of ink by the application of the aforesaid thermal energy. The invention also relates to a recording apparatus using such recording head.

For the typical structure and operational principle of such method, it is preferable to adopt those implemental by the application of the fundamental principle disclosed in the specifications of U.S. Pat. Nos. 4,723,129 and 4,740,796, for example. This method is applicable to the so-called on-demand type recording and a continuous type recording as well. Here, in particular, with the application of at least one driving signal that corresponds to recording information, the on-demand type provides an abrupt temperature rise beyond nuclear boiling by each of the electro-thermal converting elements (the non-linear type elements 1 and the resistive heat generating elements 2 for the present invention) arranged corresponding to a sheet or a liquid path where liquid (ink) is retained. Then, thermal energy is generated by each of the electro-thermal converting elements, hence creating film boiling on the thermal activation surface of recording head to effectively form resultant bubbles in liquid (ink) one to one corresponding to each of the driving signals. Now, by the growth and shrinkage of each bubble, liquid (ink) is discharged through each of the discharge openings, thus forming at least one droplet. The driving signal is more preferably in the form of pulses because the growth and shrinkage of each bubble can be made instantaneously and appropriately so as to attain the performance of excellent discharges of liquid (ink), in particular, in terms of the response action thereof. The driving signal given in the form of pulses is preferably such as disclosed in the specifications of U.S. Pat. Nos. 4,463,359 and 4,345,262. In this respect, the temperature increasing rate of the thermoactive surface is preferably such as disclosed in the specification of U.S. Pat. No. 4,313,124 for the excellent recording in a better condition.

What is claimed is:

1. An ink jet recording head comprising:

a resistive heat generating element; and a non-linear type element connected to said resistive heat generating element in series and having MIM type current voltage characteristics such that a resistive value of said non-linear type element is higher when a lower voltage is applied thereto than when a higher voltage is applied thereto, for driving said resistive heat generating element without depending on polarity, wherein said resistive heat generating element and said non-linear type element are both provided in ink and contributive to the generation of a bubble for discharging the ink.

2. An ink jet recording head according to claim 1, wherein, upon application of electric power, said resistive heat generating element and said non-linear type element connected in series each generate bubbles individually almost simultaneously.

3. An ink jet recording head according to claim 1, wherein, upon application of electric power, said resistive heat generating element and said non-linear type element connected in series each generate bubbles individually at different timings.

4. An ink jet recording head according to claim 1, wherein, upon application of electric power, said resistive heat generating element and said non-linear type element connected in series generate one bubble.

5. An ink jet recording head according to claim 1, wherein said ink jet recording head enables said resistive heat generating element to generate the bubble without generating the bubble on said non-linear type element, upon application of electric power to said resistive heat generating element and said non-linear type element.

6. An ink jet recording head according to claim 1, wherein said resistive heat generating element and said non-linear type element connected in series are arranged substantially in parallel to an ink discharging direction.

7. An ink jet recording head according to claim 1, wherein said resistive heat generating element and said non-linear type element connected in series are arranged substantially perpendicular to an ink discharging direction.

8. An ink jet recording head according to claim 1, wherein a unit having said resistive heat generating element and said non-linear type element connected in series is arranged on an intersecting point of a matrix circuit formed by scanning electrodes to input selection potential waveforms intersecting information electrodes to input information potential waveforms in accordance with image signals.

9. An ink jet recording head according to claim 1, wherein said ink jet recording head is provided with matrix electrodes to structure a matrix circuit for applying voltage to said resistive heat generating element and said non-linear type element connected in series.

10. An ink jet recording head according to claim 9, wherein said non-linear type element is arranged on an intersecting point of said matrix electrodes.

11. An ink jet recording head according to claim 1, wherein said ink jet recording head discharges the ink by generating film boiling in the ink with thermal energy generated on said resistive heat generating element and said non-linear type element.

12. An inkjet recording apparatus comprising:

an ink jet recording head for recording on a recording medium, said ink jet recording head being provided with (i) a resistive heat generating element and (ii) a non-linear type element connected to said resistive heat generating element in series and having MIM type current voltage characteristics such that a resistive value of said non-linear type element is higher when a lower voltage is applied thereto than when a higher voltage is applied thereto, for driving said resistive heat generating element without depending on polarity; and carrying means for carrying the recording medium, wherein said resistive heat generating element and said non-linear type element are both provided in ink, wherein said ink jet recording head enables both said resistive heat generating element and said non-linear type element to be made contributive to the generation of a bubble for discharging the ink, said ink jet recording head being provided with a discharge port to face said resistive heat generating element and said non-linear type element for discharging the ink to a surface of a recording medium, and wherein said ink jet recording apparatus is provided with a controlling portion for controlling electric power to be supplied to said resistive heat generating element and said non-linear type element connected in series.

13. An ink jet recording apparatus according to claim 12, wherein, upon application of electric power, said resistive heat generating element and said non-linear type element connected in series each generate bubbles individually almost simultaneously.

14. An ink jet recording apparatus according to claim 12, wherein in said ink jet recording head a first threshold voltage for generating the bubble on said non-linear type element is larger than a second threshold voltage for generating the bubble on said resistive heat generating element, and wherein said controlling portion controls electric power to be supplied to said resistive heat generating element and said non-linear type element connected in series, and controls whether the bubble is generated on both said resistive heat generating element and said non-linear type element connected in series, or the bubble is generated only on said resistive heat generating element.

15. An ink jet recording apparatus according to claim 12, wherein, upon application of electric power, said resistive heat generating element and said non-linear type element connected in series each generate bubbles individually at different timings.

16. An ink jet recording apparatus according to claim 12, wherein, upon application of electric power, said resistive heat generating element and said non-linear type element connected in series generate one bubble.

17. An ink jet recording method using an ink jet recording apparatus according to claim 12, comprising the step of:

recording by discharging the ink from the ink jet recording head for the adhesion of the ink to the recording surface of the recording medium.

18. An ink jet recording method according to claim 17, wherein the ink is discharged by generation of bubbles individually almost simultaneously by the resistive heat generating element and the non-linear type element connected in series, upon application of electric power to the resistive heat generating element and the non-linear type element connected in series.

19. An ink jet recording method according to claim 17, wherein the ink is discharged by generation of bubbles individually at different timings by the resistive heat generating element and the non-linear type element connected in series, upon application of electric power to the resistive heat generating element and the non-linear type element connected in series.

20. An ink jet recording method according to claim 17, wherein in the ink jet recording head a first threshold voltage for generating the bubble on the non-linear type element is larger than a second threshold voltage for generating the bubble on the resistive heat generating element, and wherein ink is discharged by the generation of the bubble only on the resistive heat generating element upon application of electric power having a voltage not less than the second threshold voltage and less than the first threshold voltage to the resistive heat generating element and the non-linear type element connected in series.

* * * * *